US010081520B2

(12) United States Patent
Smith et al.

(10) Patent No.: US 10,081,520 B2
(45) Date of Patent: Sep. 25, 2018

(54) LINE HAULING DEVICE

(71) Applicant: Lewmar Limited, Hampshire (GB)

(72) Inventors: Nigel Christopher Smith, Warsash (GB); Philip David Roberts, Fareham (GB); Oliver Falconer, Waterlooville (GB)

(73) Assignee: LEWMAR LIMITED, Hampshire (GB)

( * ) Notice: Subject to any disclaimer, the term of this patent is extended or adjusted under 35 U.S.C. 154(b) by 887 days.

(21) Appl. No.: 14/542,878

(22) Filed: Nov. 17, 2014

(65) Prior Publication Data

US 2015/0137054 A1 May 21, 2015

(30) Foreign Application Priority Data

Nov. 19, 2013 (GB) ..... 1320441.7

(51) Int. Cl.
*B66D 1/38* (2006.01)
*B63B 21/16* (2006.01)

(52) U.S. Cl.
CPC ..... *B66D 1/38* (2013.01); *B63B 21/16* (2013.01)

(58) Field of Classification Search
CPC ..... B66D 1/38; B66D 1/36; B63B 21/16
See application file for complete search history.

(56) References Cited

U.S. PATENT DOCUMENTS 2,412,776 A 12/1946 Johnson
3,395,893 A 8/1968 Kumpf
4,334,670 A * 6/1982 Kawabe ..... B66D 1/38 242/397.3
4,767,073 A 8/1988 Malzacher
6,182,592 B1 2/2001 Molz
(Continued)

FOREIGN PATENT DOCUMENTS

CN 202 848 949 4/2013
CN 203 173 729 9/2013
DE 30 34 707 4/1982
(Continued)

OTHER PUBLICATIONS espacenet.com, Translation of FR-1489082-A, retrieved Jul. 2, 2018 (Year: 2018).*
(Continued)

*Primary Examiner* — Sang K Kim
*Assistant Examiner* — Nathaniel L Adams
(74) *Attorney, Agent, or Firm* — Leason Ellis LLP

(57) ABSTRACT

A line hauling device such as a windlass is disclosed for marine craft. The device has a support, a drum held on the support and rotatable with respect to the support, a motor for selectably driving rotation of the drum in a forward (hauling) direction and a reverse (paying out) direction, and a line laying mechanism for laying the line onto the drum. The drum is adapted to store the line on the drum. When operated in the forward direction, the line-laying mechanism lays the line onto the drum in a first series of turns. On completion of the first series of turns the line-laying mechanism lays the line in a second series of turns overlying the first series of turns. The line-laying mechanism includes a carriage which is driven reciprocally with respect to the drum by rotation of the drum.

9 Claims, 10 Drawing Sheets

(56) References Cited

U.S. PATENT DOCUMENTS

| | | | |
|---|---|---|---|
| 6,443,431 | B1 | 9/2002 | Stasny et al. |
| 2008/0054118 | A1 | 3/2008 | Czajkowski |

FOREIGN PATENT DOCUMENTS

| | | | | | |
|---|---|---|---|---|---|
| FR | 1489082 | A | * | 7/1967 | ..... B66D 1/36 |
| GB | 2 041 317 | | | 9/1980 | |
| KR | 2012 0003859 | | | 6/2012 | |
| WO | WO 2011/035388 | | | 3/2011 | |

OTHER PUBLICATIONS

Lewmar Pro-Series windlass, Part No. 6657011198-311 (http://www.lewmar.com/products.asp?id=8329&lid=25799 accessed Nov. 18, 2013).

* cited by examiner

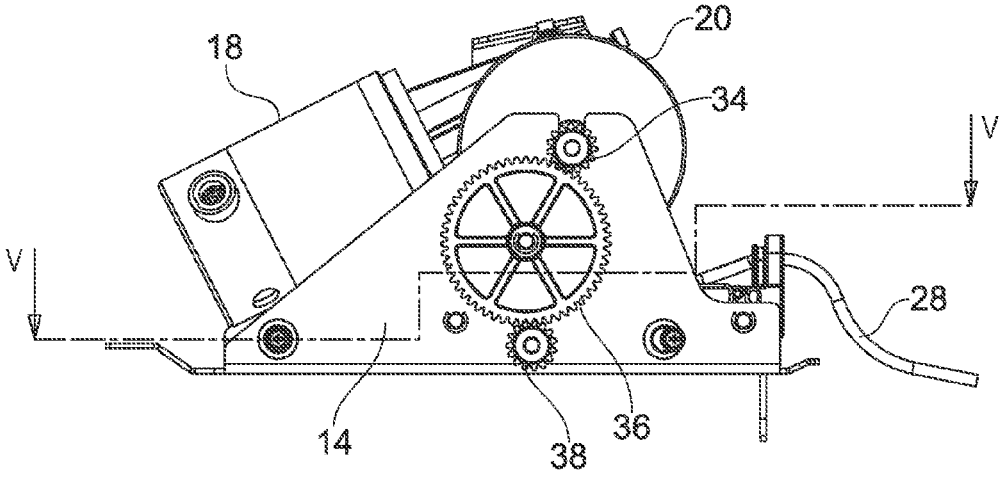
FIG. 3
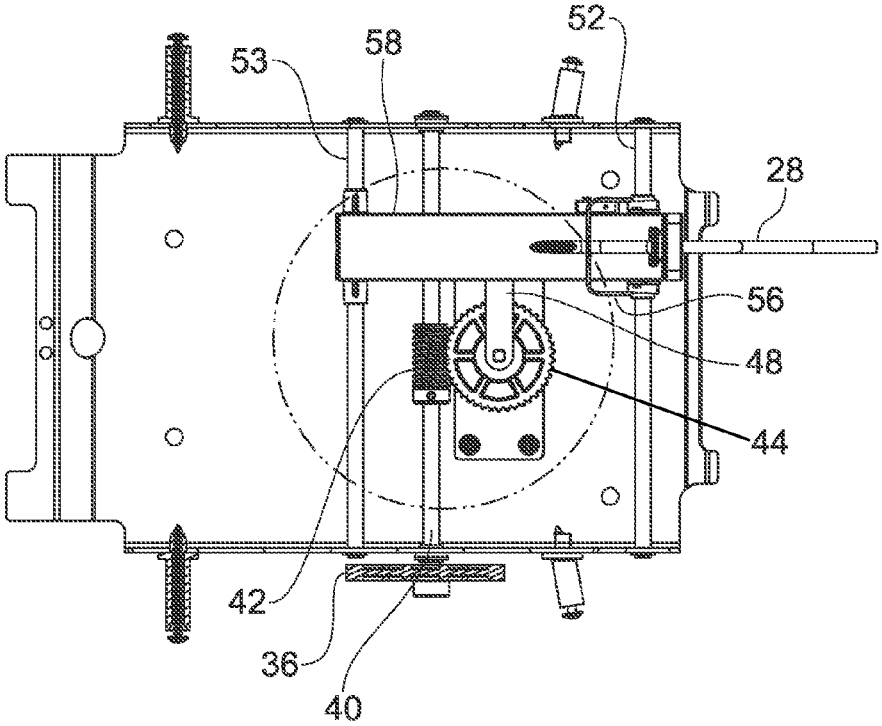
FIG. 4 SECTION V-V

LINE HAULING DEVICE

CROSS-REFERENCE TO RELATED APPLICATIONS

This application is based on and claims priority under 35 USC 119 from Great Britain Patent Application No. 1320441.7, filed on Nov. 19, 2013, the entire content of which is incorporated herein by reference.

BACKGROUND TO THE INVENTION

Field of the Invention

The present invention relates to a line hauling device. It is of particular interest for use on marine craft such as a sailboat or a powerboat typically used for leisure. The line hauling device may, for example, be a windlass. Alternatively, the line hauling device may be a winch.

Related Art

A form of windlass having a gypsy (in which a line and/or chain executes only a single turn between inward and outward runs) is commonly used on marine craft to haul and veer the anchor rode i.e. the line and/or chain. Since the combined weight of the anchor and chain can be relatively great, windlasses powered by electric or hydraulic motors are known. These typically haul the chain over the gypsy of the windlass and allow the anchor rode to fall under gravity into an anchor locker under the deck of the craft at the bow. One example of such a windlass is the Lewmar Pro-Series windlass, Part Number: 6657011198-311 (http://www.lewmar.com/products.asp?id=8329&lid=25799 accessed 18 Nov. 2013).

SUMMARY OF THE INVENTION

The present inventors have realised that the anchor rode storage used with known windlass systems, in which the anchor rode is stored in an anchor locker as described above, has several disadvantages. One such disadvantage is that the anchor locker takes up a significant volume of below-deck space on the craft, in view of the need to provide both a space for the accumulated anchor rode and a sufficient height for the anchor rode to fall into the anchor locker. Another disadvantage is the noisy accumulation of anchor rode in the anchor locker during hauling, particularly the chain part of the anchor rode.

It is known to provide some of the anchor rode in the form of rope, in view of weight and cost requirements. However, as will be readily understood, rope has different characteristics to chain. Rope stores differently in the anchor locker compared with chain, and is liable to become more easily tangled than chain in the anchor locker during anchor let out. It is desirable to use rope as a significant part of the anchor rode, in view of the developments in rope technology which have led to very high strength, low weight ropes.

The present invention has been devised in order to address at least one of the above problems. Preferably, the present invention reduces, ameliorates, avoids or overcomes at least one of the above problems.

Accordingly, in a first preferred aspect, the present invention provides a line hauling device for marine craft, the device having:

a support;

a drum held on the support and rotatable with respect to the support;

a motor for selectably driving rotation of the drum in a forward (hauling) direction and a reverse (paying out) direction; and a line laying mechanism for laying the line onto the drum, wherein the drum is adapted to store the line on the drum and wherein, in operation in the forward direction, the line-laying mechanism lays the line onto the winch drum in a first series of turns and on completion of the first series of turns, lays the line in a second series of turns overlying the first series of turns.

In a second preferred aspect, the present invention provides a method of operation of a line hauling device according to the first aspect to haul in or pay out a line.

The first and/or second aspect of the invention may have any one or, to the extent that they are compatible, any combination of the following optional features.

Preferably, the line hauling device is a windlass. Preferably, the line is an anchor rode.

It is preferred that a third layer of turns of the line can be laid on the winch drum, overlying the second layer of turns. Further layers of turns may be provided, dependent on the capacity of the drum and the required length of line to be stored on the drum.

Preferably, the drum includes end walls radially extending away from an axis of rotation of the drum. The end walls preferably operate to contain the layers of turns of line on the drum.

The line laying mechanism preferably operates to move a carriage guiding the line between the drum and a free end of the line. The carriage is preferably moved reciprocally with respect to the drum. Preferably, movement of the carriage is driven by rotation of the drum. This can be achieved for example by a gear train or by a timing belt arrangement. The carriage may be moved by a cooperation of a rotatable arm and a linear track. In this manner, rotation of the rotatable arm by 180° can correspond to laying one layer of turns of line fully across the width of the drum. Continuous rotation of the arm therefore preferably causes reciprocation of the carriage which in turn causes the line to be guided onto the drum at a suitable axial position along the drum to form a neat winding of the line onto the drum. A first Layer of line may therefore be formed from a series of neatly wound turns on the drum. When the first layer is complete, further rotation of the drum in the forwards direction preferably causes the direction of travel of the carriage to reverse, so that the line is wound in a series of neat turns in a second Layer, overlying the first layer.

Preferably, the windlass includes a cover. This can help with the safe operation of the windlass, by preventing the accidental trapping of fingers or clothing in the winding line on the drum. The cover may include a window positioned to allow viewing on the drum and the line stored on the drum. This allows the user to gauge the correct operation of the device and to see how much line is left on the drum. The cover preferably includes a slot sized and located in order to allow the line to exit the device from any position on the drum. Preferably the slot is a Laterally extending slot, extending is direction parallel to the direction of rotation of the drum.

The windlass is preferably configured so that the drum will stop paying out when it is determined that the number of turns of line remaining on the drum has reached a certain number. This allows the user the security that the line will remain firmly secured to the drum even when paying out a significant length of line.

Preferably, the device includes a switch which is operated to prevent pay out operation of the motor when the load on the line is reduced below a threshold level. This allows effective "drift" fishing to be performed. The switch is preferably a spring-loaded clamp which operates a switch as defined above when the load on the free end of the line is below a threshold level. When the load on the free end of the rope rises above the threshold level, preferably the load overcomes the spring Loading force and the switch is deactivated, allowing further operation of the motor to pay out further line.

Further optional features of the invention are set out below.

BRIEF DESCRIPTION OF THE DRAWINGS

Embodiments of the invention will now be described by way of example with reference to the accompanying drawings in which:

FIG. 3 shows a side view of the embodiment of FIG. 1.

FIG. 4 shows a sectional view along line V-V in FIG. 3.

Figure 1:
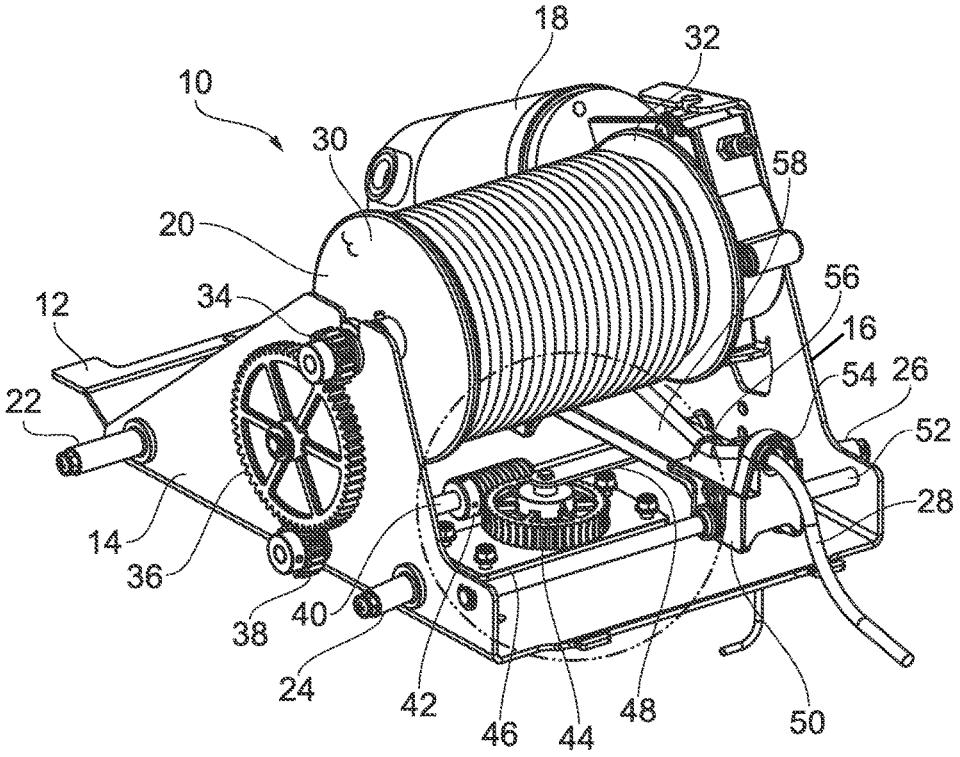
FIG. 1 shows a perspective view of a windlass according to an embodiment of the invention, with the cover removed.
Figure 2:
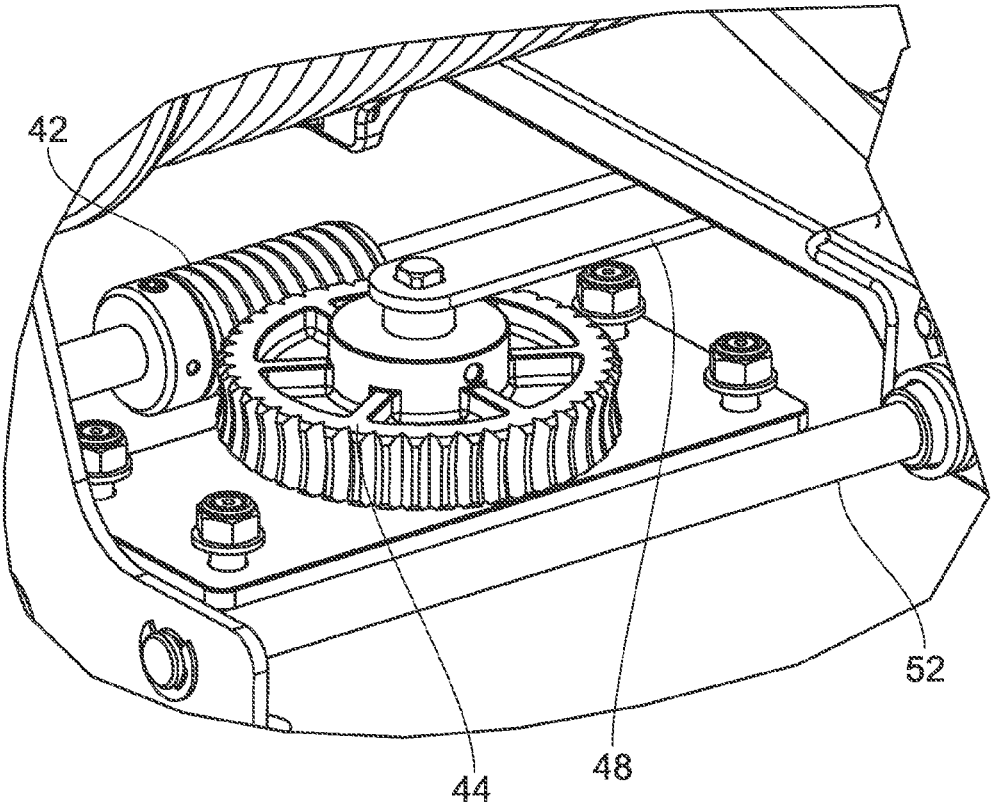
FIG. 2 shows an enlarged view of a part of FIG. 1, marked in FIG. 1 with a dash-double-dot circle.
Figure 5:
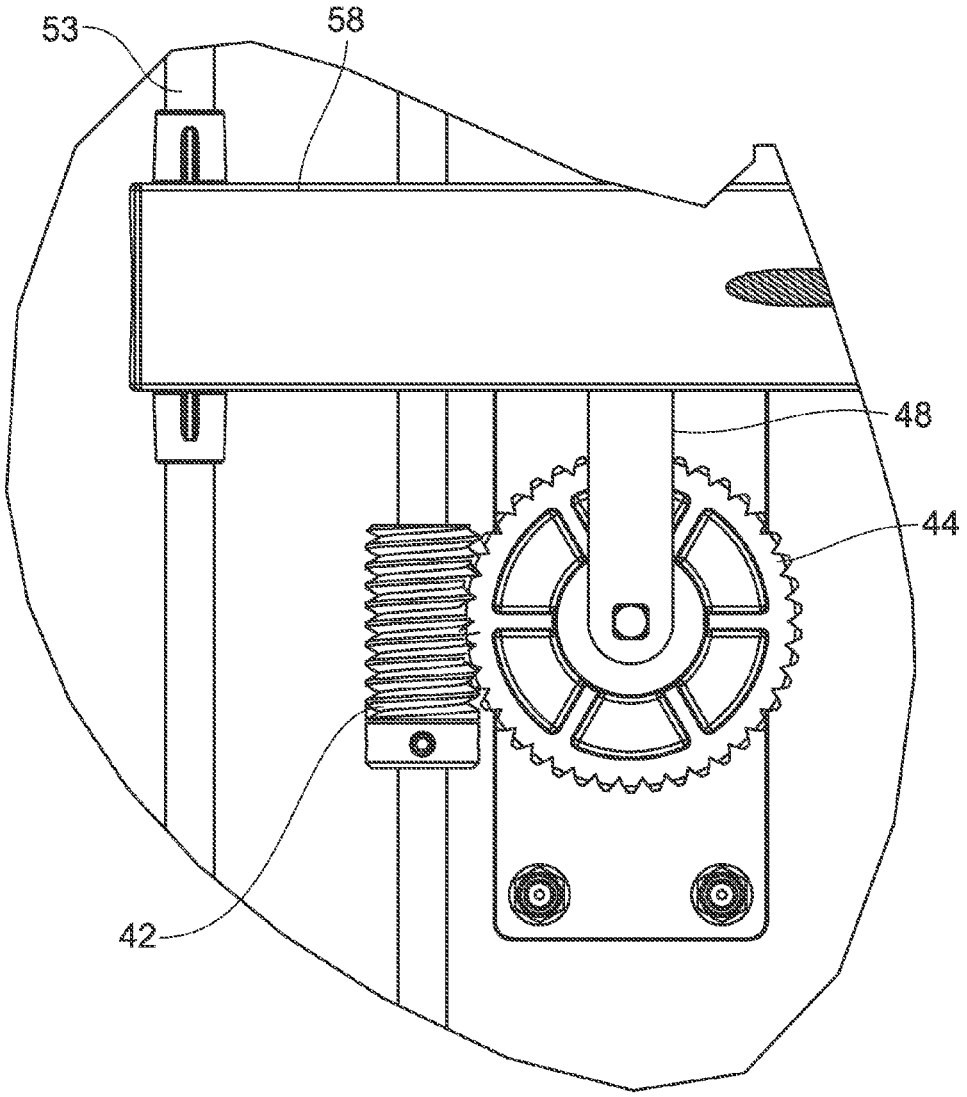
FIG. 5 shows an enlarged view of a part of FIG. 4, marked in FIG. 4 with a dash-double-dot circle.
Figure 6:
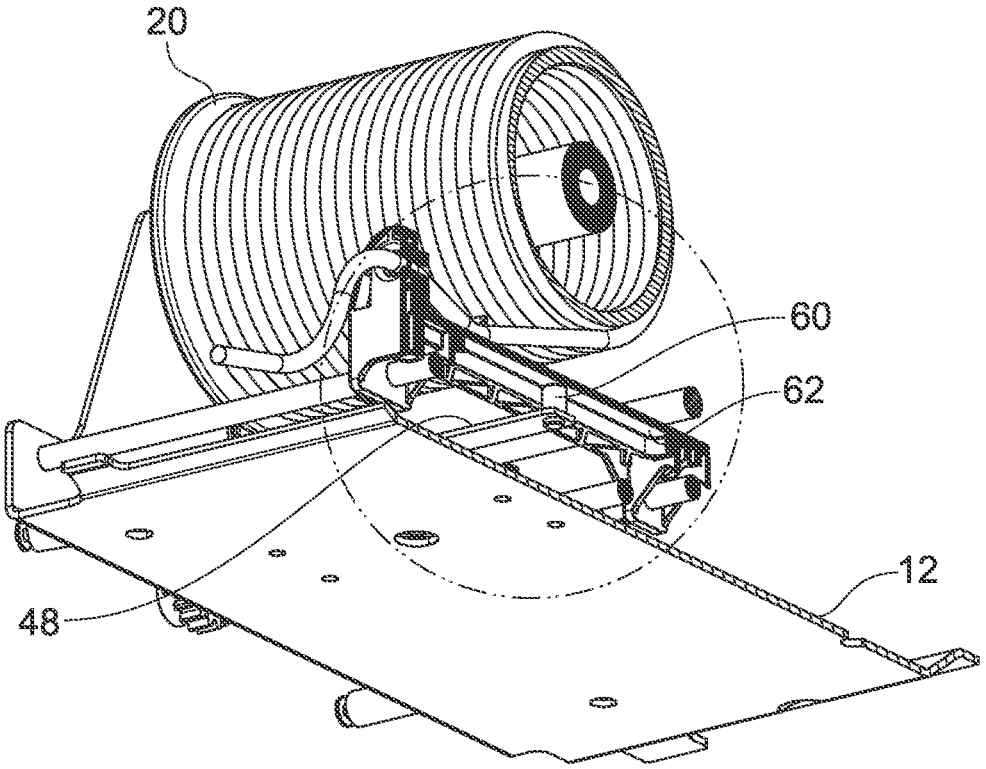
FIG. 6 shows a partial sectional view from below of the embodiment of FIG. 1.

DETAILED DESCRIPTION OF THE PREFERRED EMBODIMENTS, AND FURTHER OPTIONAL FEATURES OF THE INVENTION

The preferred embodiment of the invention is a captive reel windlass. It is intended for anchoring either a powerboat or sailboat up to about 28 feet long, referred to herein as a marine craft. It will be readily apparent to the skilled reader that the preferred embodiment described here can be scaled, up or down, to be suitable for use with larger or smaller vessels.

A first embodiment will be described with reference to FIGS. 1-9 in which the same reference numerals are used for the same features.

The windlass 10 includes a support plate 12 adapted to be fixed to the deck of the marine craft (not shown). The support plate is typically formed from stainless steel for corrosion resistance. Support plate 12 is formed in a shape including upstanding arms 14, 16. Arm 16 support motor 18. Arms 14 and 16 support drum 20 and allow rotation of drum via suitable bearings (not shown). Motor 18 drives rotation of drum 20 via a transmission (not shown) in the forward (hauling) direction and a reverse (paying out) direction, Support 12 also has mounting points 22, 24, 26 for the attachment of a cover (not shown in FIGS. 1-9).

A first end (not shown) of an anchor rode 28 is attached to drum 20. A second end (not shown) of the anchor rode is attached to an anchor, or to an anchor chain which is in turn attached to an anchor.

The drum 20 is in the form of a reel, having end walls 30, 32 of suitable radial extent to confine multiple layers of turns of the anchor rode on the drum.

Rotation of drum 20 drives gear 34 which in turn drives gear 36 mounted on side wall 14. Rotation of gear 36 drives gear 38 which is sized to rotate at the same speed as gear 34. In alternative embodiments, gear 36 can be replaced with a suitable arrangement of a toothed timing belt and guide between gears 34 and 38.

Gear 38 is attached to rotatable shaft 40, held for rotation between arms 14 and 16 of the support. A worm gear 42 is fixed to rotatable shaft 40 and engages with a horizontal gear wheel 44. Gear wheel 44 is rotatable about plate 46, which in turn is fixed to the support 12. Arm 48 is rotatable with gear wheel 44, rotation of the arm causing the mechanical effect described in more detail below.

A line laying mechanism is provided in the form of rode-laying carriage 50 which is translationally moveable along fixed shafts 52, 53, held between arms 14, 16 of the support 12. Carriage 50 includes a fairlead 54 to guide the rope lode 28 through the carriage to the drum 20 via a sprung load-detecting device 56 described in more detail below. Carriage 50 also includes frame 58 extending between shafts 52, 53.

Gearing 34, 36, 38, 42 and 44 is arranged so that gear wheel 44 rotates 180° in order to correspond to laying one layer of turns of rode fully across the width of drum 20. Arm 48, connected to gear wheel 44 at its proximal end, includes a boss 60 at its distal end, as best shown in FIGS. 6-9. Boss 60 fits in corresponding slot 62 in the underside of frame 58. Rotation of arm 48 causes boss 60 to slide in slot 62 and so cause lateral movement of frame 58 and thus of carriage 50. The limit of travel of the carriage 50 is defined by the position of arm 48 as shown in the drawings and at 180° from this position. Thus, continuous rotation of arm 48 causes reciprocation of carriage 50. In turn, this causes the rode to be guided onto the drum 20 at a suitable axial position along the drum to form a neat winding of the rode onto the drum. A first layer of rode is therefore formed from a series of neatly wound turns on the drum, from end wall 30 to end wall 32 of the drum. When the first layer is complete, further rotation of the drum in the forwards direction causes the direction of travel of the carriage 50 to reverse, so that the rode is wound in a series of neat turns in a second layer, overlying the first layer. A third layer can be formed over the second layer and so on.

In this manner, the rode can be stored neatly on the drum in a series of layers, so that a very significant length of rode can be stored without the need for an anchor locker.

Figure 7:
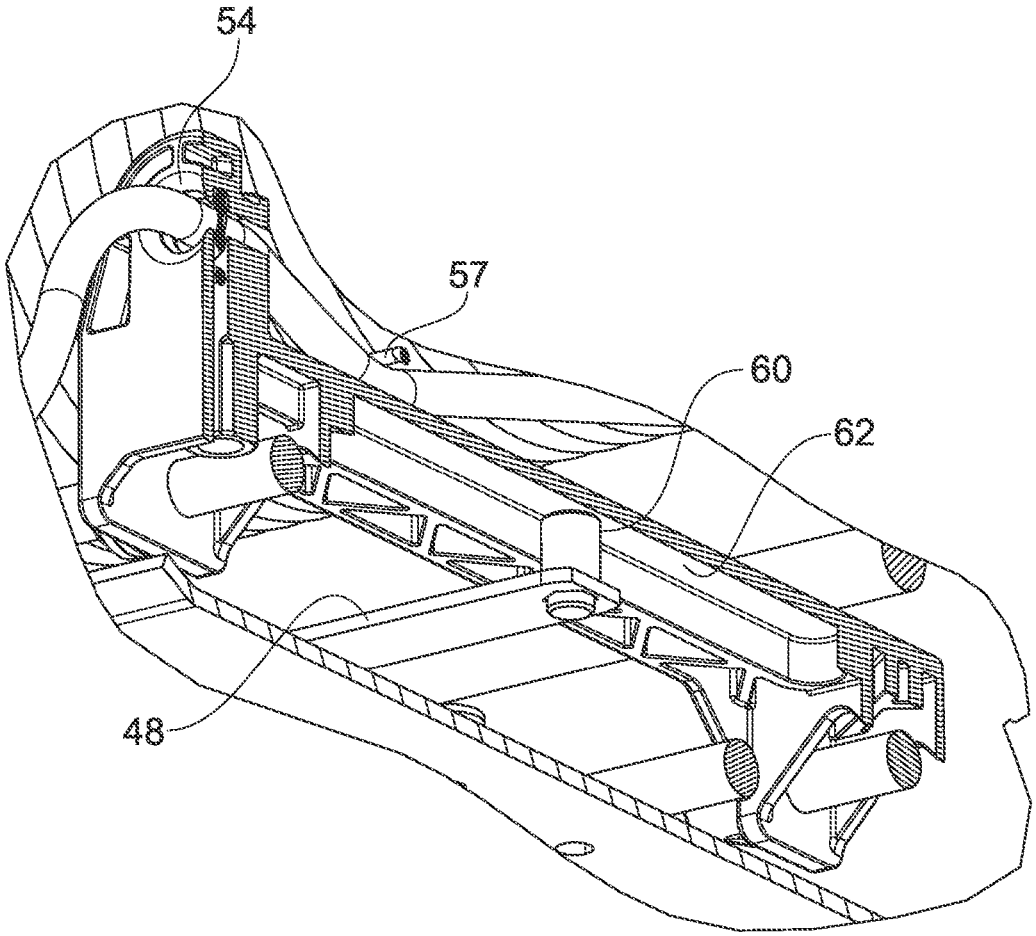
FIG. 7 shows an enlarged view of a part of FIG. 6, marked in FIG. 6 with a dash-double-dot circle.
Figure 8:
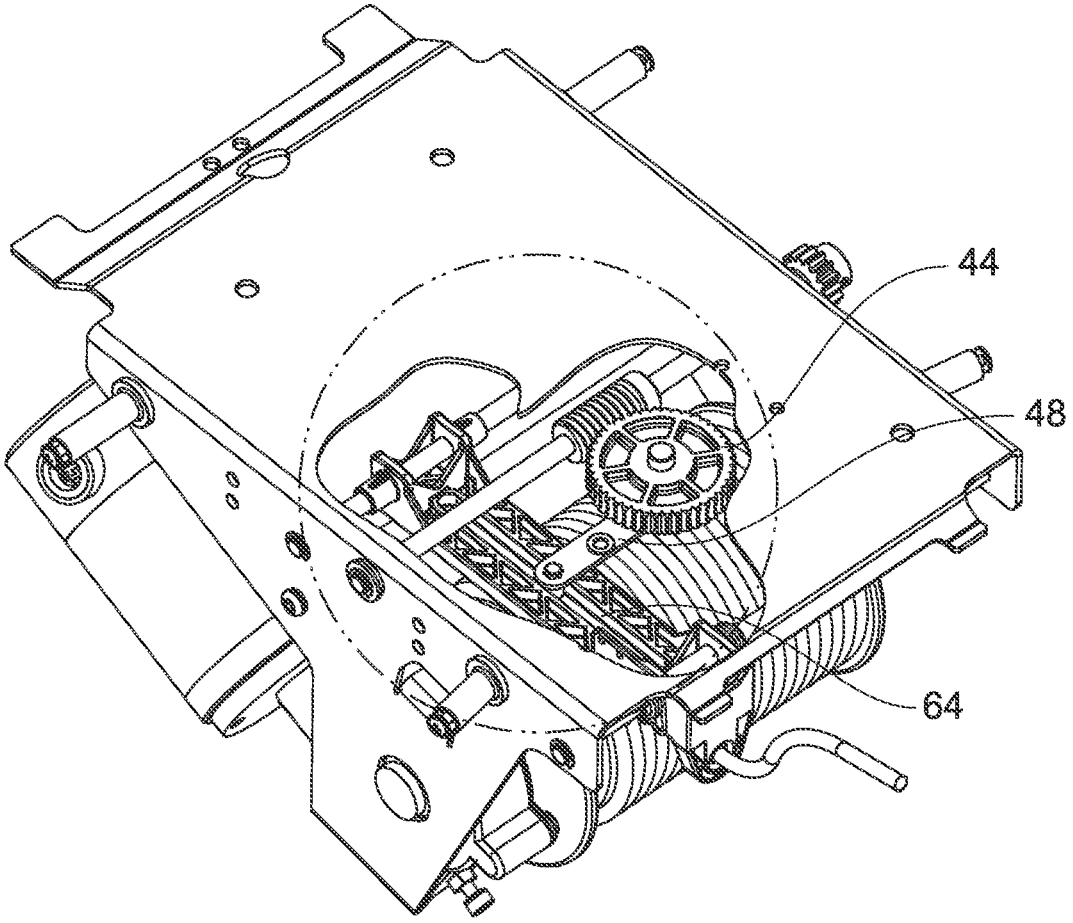
FIG. 8 shows a view from below of the embodiment of FIG. 1, with part of the base omitted.
Figure 9:
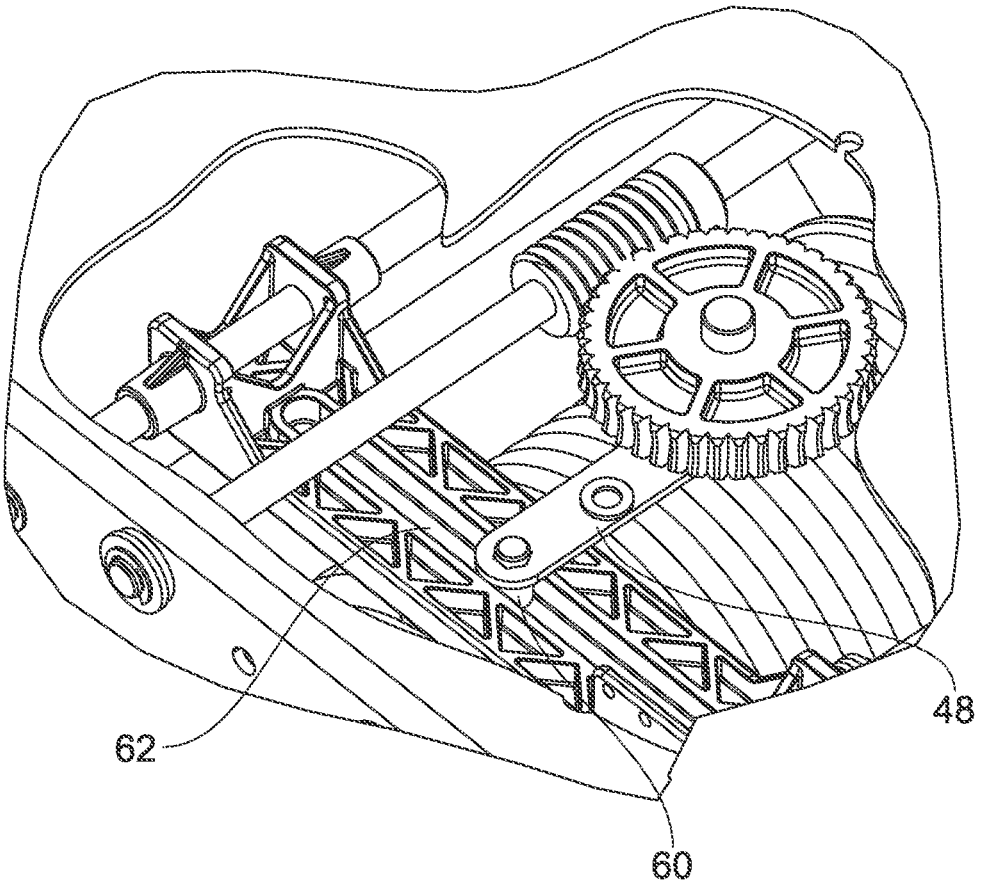
FIG. 9 shows an enlarged view of a part of FIG. 8, marked in FIG. 8 with a dash-double-dot circle.

As shown in FIG. 1, sprung load-detecting device 56 takes the form of a wire spring 55 mounted with respect to carriage 50. The device has a portion 57 for bearing down on the rode to provide a mild frictional engagement with the upper surface of frame 58, as shown in FIG. 7.

Figure 11:
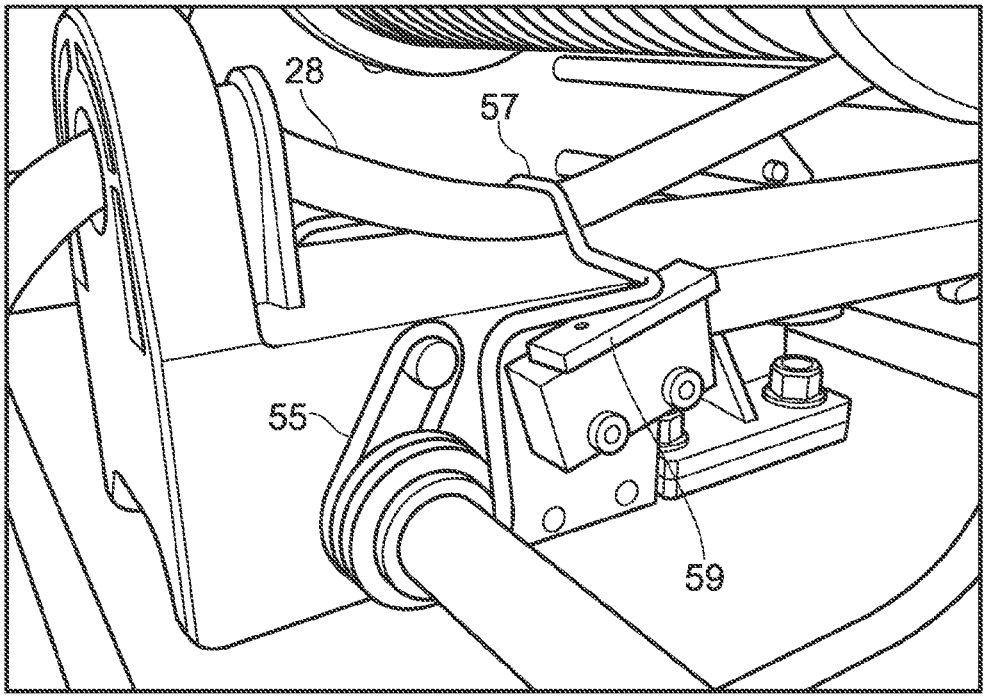
FIG. 11 shows an enlarged partial view of part of the embodiment of FIG. 10, with the cover removed.

The function of the sprung load-detecting device is best explained with reference to FIG. 11. Here spring wire 55 is mounted with respect to the carriage so that it is urged towards the frame to deviate the rode and mildly press the rode to the upper surface of the frame of the carriage. A relatively small load on the free end of the rode is sufficient to lift the sprung load-detecting device. Lifting of the sprung load-detecting device operates a switch 59 to allow activation of the motor to drive rotation of the drum. This is beneficial particularly where the windlass is being operated to pay out the anchor rode. The weight of the anchor and rode is sufficient to lift the sprung load-detecting device and allow rotation of the drum. However, once the anchor reaches the sea bed, the load is much reduced. This reduced load is counteracted by the spring tension in the sprung load-detecting device and the device engages the switch to prevent further pay out rotation of the drum. Thus, the rode is prevented from further paying out when the rode is slack.

The windlass also includes an auto-stop feature so that when paying out rode from the drum, when the final layer of rode is reached on the drum, the drum is prevented from further rotation when only a certain number of turns of rode remains on the drum. This is achieved based on the drum only being allowed a certain number of revolutions from maximum storage capacity towards full pay out. This allows the operator the security that a safe number of turns of rode will remain on the drum, for example when anchoring in deep water.

Figure 10:
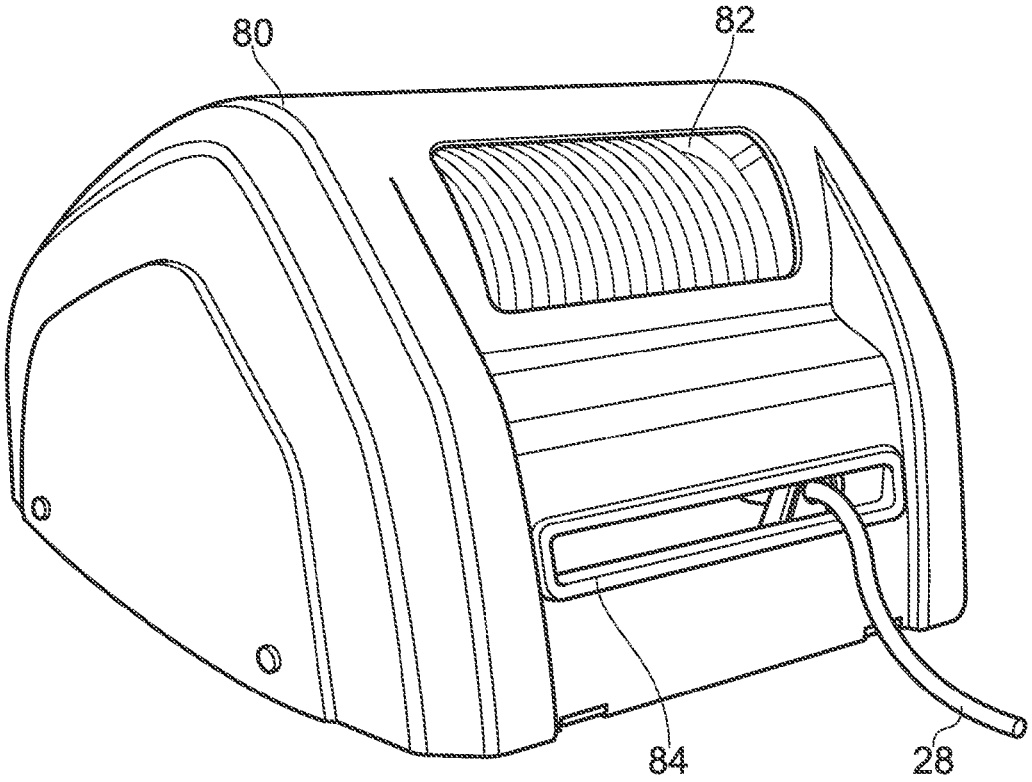
FIG. 10 shows a perspective view of a windlass according to another embodiment of the invention, including the cover removed.

As shown in FIG. 10, the windlass has a housing 80 which covers the drum and the rode-laying mechanism. An integrated switch (not shown) is fitted to the rear of the housing. Alternatively, a remote control can be used to operate the windlass.

As also shown in FIG. 10, the housing 80 includes a covered window 82, to allow the correct operation of the rode storage and pay out to be observed. The use of a cover limits the possibility of accidental trapping of fingers or clothing in the rode being wound on the drum. The housing includes a horizontal slot 84 of suitable extent to allow the rode to enter and exit the housing across the full extent of travel of the fairlead on the carriage.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A line hauling device for marine craft, the device having:

a support;

a drum held on the support and rotatable with respect to the support;

a motor for selectably driving rotation of the drum in a forward (hauling) direction and a reverse (paying out) direction; and a line laying mechanism for laying a line onto the drum, wherein the drum is adapted to store the line on the drum and wherein, in operation in the forward direction, the line-laying mechanism lays the line onto the drum in a first series of turns and on completion of the first series of turns, lays the line in a second series of turns overlying the first series of turns, wherein the line laying mechanism is operable to move a carriage guiding the line between the drum and a free end of the line, in which operation the carriage is moved reciprocally with respect to the drum, movement of the carriage being driven by rotation of the drum driving a gear wheel having a rotatable arm extending radially from the gear wheel, the rotatable arm having a boss at one end cooperating with a slot formed in a frame fixed with respect to the carriage, rotation of the rotatable arm thereby causing the boss to slide in the slot and drive reciprocating movement of the frame and the carriage.

2. A line hauling device according to claim 1 wherein the line hauling device is a windlass and the line is an anchor rode.

3. A line hauling device according to claim 1 wherein at least a third layer of turns of the line can be laid on the drum, overlying the second layer of turns.

4. A line hauling device according to claim 1 wherein the drum includes end walls radially extending away from an axis of rotation of the drum, the end walls being capable of containing the layers of turns of line on the drum.

5. A line hauling device according to claim 1, configured so that the drum stops paying out when it is determined that the number of turns of line remaining on the drum has reached a certain number.

6. A line hauling device according to claim 1 wherein the device includes a switch which is operable to prevent pay out operation of the motor when the load on the line is reduced below a threshold level.

7. A line hauling device according to claim 1 further including a cover.

8. A line hauling device according to claim 7 wherein the cover includes a window positioned to allow viewing of the drum and the line stored on the drum.

9. A line hauling device according to claim 7 wherein the cover includes a slot sized and located in order to allow the line to exit the device from any position on the drum.

* * * * *